United States Patent [19]

Kato

[11] 4,061,447

[45] Dec. 6, 1977

[54] OIL SEAL FOR ROTARY ENGINE

[75] Inventor: Shinji Kato, Toyota, Japan

[73] Assignee: Toyota Jidosha Kogyo Kabushiki Kaisha, Toyota, Japan

[21] Appl. No.: 547,339

[22] Filed: Feb. 5, 1975

[51] Int. Cl.[2] ..... F01C 19/12

[52] U.S. Cl. ..... 418/142

[58] Field of Search ..... 418/142; 277/219, 218

[56] References Cited

U.S. PATENT DOCUMENTS

| | | | |
|---|---|---|---|
| 421,646 | 2/1890 | Ambrose | 277/219 |
| 2,591,176 | 4/1952 | Mason | 277/219 |
| 2,738,243 | 3/1956 | Sawyer | 277/219 |
| 3,359,951 | 12/1967 | Sabet | 418/142 X |
| 3,384,055 | 5/1968 | Glenday et al. | 418/142 X |

FOREIGN PATENT DOCUMENTS

| | | | |
|---|---|---|---|
| 1,260,660 | 4/1961 | France | 418/142 |
| 138,062 | 2/1921 | United Kingdom | 418/142 |

*Primary Examiner*—Carlton R. Croyle
*Assistant Examiner*—Leonard E. Smith
*Attorney, Agent, or Firm*—Stevens, Davis, Miller & Mosher

[57] ABSTRACT

An oil seal for a rotary engine in which a seal ring, or a seal ring and an elastic ring, is/are fitted in the interior of an annular recess provided in each side of the rotor, characterized in that the seal ring or elastic ring is placed into said annular recess with an initial radial stress so as to produce an axial force by virtue of the slant of said annular recess or the slant of the elastic ring for maintaining airtightness between the seal ring and the side housing.

11 Claims, 17 Drawing Figures

OIL SEAL FOR ROTARY ENGINE

BACKGROUND OF THE INVENTION

1. Field of the Invention

This invention relates to an oil seal device for a rotary engine provided between a rotor and a side housing to prevent lubricating oil on the eccentric shaft side from flowing into the operating chamber.

2. Description of the Prior Art

In a typical prior art oil seal device for a rotary engine, an annular recess is provided in each side of the rotor and a seal ring is fitted in said recess. In the innermost part of the sealing recess is disposed an undulate spring adapted for pressing the seal ring against the side housing. When the rotor makes eccentric rotation, the seal ring is also caused to make corresponding eccentric rotation while scraping off lubricating oil on the sliding face of the side housing. The lubricating oil which has performed cooling of the rotor and lubrication of bearings, gears and such is thus prevented from leaking into the operating chamber from between the side housing and the thrust surface of the rotor. Also, an O-ring or like means is provided radially on the inner or outer peripheral face of the seal ring to keep off the lubricating oil that enters between the seal ring and the sealing recess. Thus, such prior art oil seal device had problems in that an O-ring must be provided for preventing leakage of lubricating oil at or in the surrounding of the spring adapted for pressing the seal ring, that the sealing performance is unstable because the seal ring pressing force of the undulate spring is not uniform, and that the O-ring becomes soon aged as it is exposed to high temperatures, causing unstable sealing performance.

SUMMARY OF THE INVENTION

The present invention then aims at providing an oil seal device which can improve the sealing performance with no need of providing an O-ring or an undulate spring in the seal device. According to the present invention, an annular recess is provided in the thrust surface of the rotor, and a seal ring capable of contracting or expanding radially, or a seal ring and an annular elastic ring designed to press said seal ring against the side housing, is/are fitted in said annular recess such that contraction or expansion of said seal ring or elastic ring will produce an axial force with the aid of the slant or slope in the annular recess or in the elastic ring, thereby to maintain constant sealing performance of the seal ring.

DESCRIPTION OF THE PREFERRED EMBODIMENTS

Figure 1:
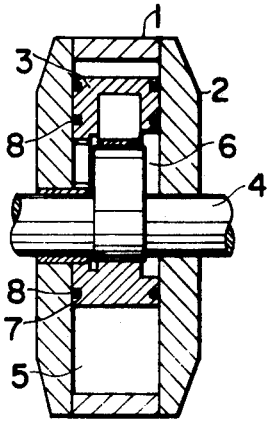
FIG. 1 is a sectional side elevation of a rotary engine adapted with an oil seal device according to the present invention.
Figure 2:
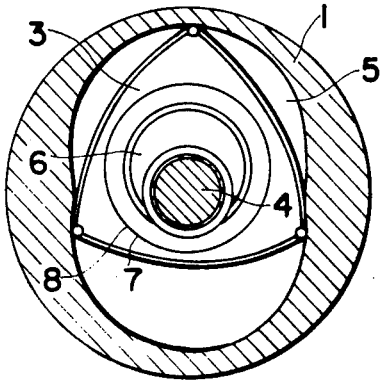
FIG. 2 is a sectional front view thereof.
Figure 3:
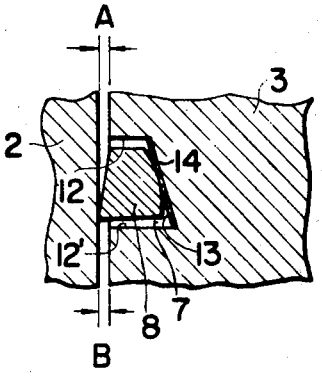
FIG. 3 is a sectional view of the primary parts of the oil seal device.
Figure 4:
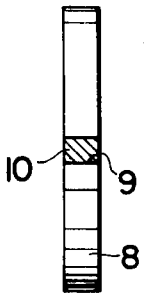
FIGS. 4 and 5 are side views of a seal ring.
Figure 5:
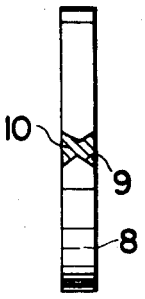
Figure 6:
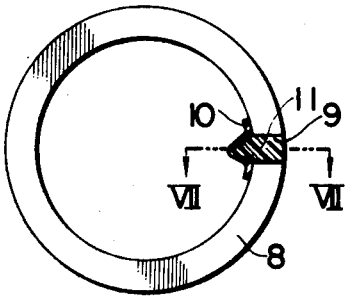
FIGS. 6 and 8 are plan views of the seal ring.
Figure 7:
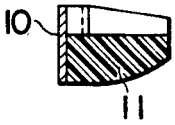
FIG. 7 is a sectional view taken on the line VII—VII of FIG. 6.
Figure 8:
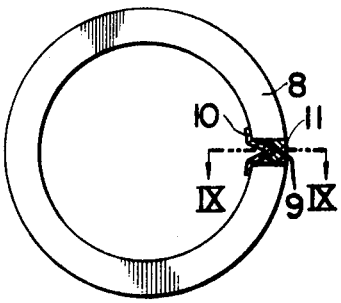
Figure 9:
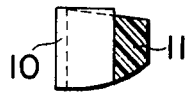
FIG. 9 is a sectional view taken on the line IX—IX of FIG. 8.

An oil seal device according to the present invention is now described in detail with reference to FIGS. 1 to 9 of the drawings. It will be seen that a rotor 3 is provided capable of making eccentric rotation in a chamber defined by a rotor housing 1 and a side housing 2 which closes both sides of said rotor housing. Eccentric rotation of said rotor 3 is transmitted to an eccentric shaft 4. Defined between the inner peripheral surface of said rotor housing 1 and the radial outer peripheral surface of said rotor 3 is an operating chamber 5 where suction, compression, explosion, and exhaust of the fuel-air mixture take place. Lubricating oil for lubricating bearings and gears for transmitting rotation to the eccentric shaft 4 is supplied into a chamber 6 in the rotor 3 through which said eccentric shaft 4 extends. In both side faces of the rotor 3 are formed annular recesses 7 in each of which fits a C-shaped seal ring 8. Instead of providing such recesses 7, an annular stepped portion may be provided around the edge of the hole in the rotor through which the eccentric shaft 4 extends, with the seal ring 8 being fitted in such stepped portion. The opposed ends 9 of the C-shaped seal ring 8 are joined by an elastic plate 10 which is secured by welding, driving fit or casting to the radial inside face of the seal ring 8, with an elastic plastic 11 or other like material being placed between said ends 9 to secure their joining. The shape of the ring ends 9 may be such as shown in FIGS. 4 and 5, and the mode of their joining may be such as shown in FIGS. 6 and 7 where the elastic plate 10 bulges out on one side or such as shown in FIGS. 8 and 9 where said plate bulges out on the opposite side. The seal ring 8 is thus provided with radial elasticity by said elastic plate 10 and plastic 11 is capable of preventing the lubricating oil in the chamber 6 from entering the operating chamber 5 by passing between the rotor 3 and the side housing 2. Any leakage of lubricating oil from the joined portion 9 is also inhibited. The two faces 12 and 12' that define the depth of the sealing recess 7 are formed perpendicular to the side surface of the rotor 3, and the bottom face of the recess 7 is slanted to provide a slope 13 so that the depth of the recess becomes smaller outwardly in the radial direction. The face of the seal ring 8 opposed to the side housing 2 is slanted such that they are contacted only along the inside peripheral edges in the radial direction, while the face of said ring 8 contacted with the slant 13 of the recess 7 is generally tapered in conformity to the said slant 13 and is also arc-shaped in section. This arrangement permits radial expansion and contraction of the seal ring 8. Although the slant 13 of the recess 7 is formed plane in the shown embodiment, it may, in some other embodiments, be arc-shaped with a curvature greater than that of the arc-shaped portion of the seal ring 8. It is desirable that the seal ring 8 and the slant 13 of the recess 7 are contacted continuously over the entire span of the seal ring 8. To this end, the surface of the slant 13 contacted with the seal ring 8 is coated with a plastic material 14 or vulcanization-bonded with a thermosetting resin. This treatment ensures perfect air-tightness between the seal ring 8 and the slant surface 13 even if finishing of the seal ring 8 and/or slant surface 13 were bad as the coated plastic material 14 makes a plastic flowing movement when the seal ring 8 is pressed against the slant surface 13. The fitting of the seal ring 8 into the recess 7 is accomplished by pushing the former in a somewhat contracted condition into the latter such that, when fitted in position, the seal ring 8 will accumulate a restorative force which produces a component force in the axial direction of the rotor 3 owing to the slant 13 of the recess 7. When the seal ring 8 is thus fitted in position, the distance A between the sliding face of the side housing 2 and the opposed face of the rotor 3 becomes equal to the distance of protrusion B of the seal ring 8 from the recess 7, as shown in FIG. 3, as the seal ring 8 is expanded or contracted radially of the recess 7, thus always maintaining airtightness between the side housing 2 and the seal ring 8.

Figure 10:
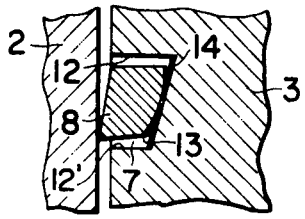
FIG. 10 is a sectional view of the principal parts of an oil seal device according to another embodiment of the present invention.

The bottom face of the recess 7 may be slanted such that the depth of the recess will increase outwardly in the radial direction of the rotor 3 as shown in FIG. 10. In this case, the face of the seal ring 8 contacted with the slant 13 of the recess 7 is also tapered correspondingly to such slant, and the fitting of the seal ring 8 into the recess 7 is effected by inserting the ring in an expanded state so that when the ring is fitted in position, its contractive force will produce a component force in the axial direction of the rotor 3 owing to the slant 13 of the recess 7.

Thus, in the present oil seal device having the above-described arrangement, the seal ring 8, when fitted in position, has a restorative force in the radial direction as the ring is fitted into the recess 7 in an expanded or contracted state, but its movement in both axial and radial directions is inhibited by the side housing 2 and the slant 13 of the recess 7, respectively. In this case, since the seal ring 8 is abutting on the slant 13, there is produced a component force in the axial direction of the rotor 3 so that the seal ring 8 is strongly pressed against the side housing 2 as well as against the slant 13 of the sealing recess 7 to produce excellent sealing effect. Thus, during eccentric rotation of the rotor 3, the seal ring 8 rotates while scraping off lubricating oil between the rotor 3 and the side housing 2, and hence there is no chance for lubricating oil in the chamber 6 to leak into the operating chamber 5. Sometimes, the rotor 3 could deflect from its normal locus during its eccentric rotation. Even in such a case, since the seal ring 8 swings about its portion linearly contacted with the bottom face of the recess 7, it maintains its pressed contact with the side housing 2 and the bottom face of the recess 7.

Figure 11:
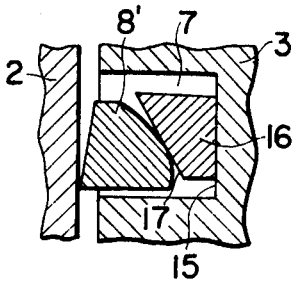
FIGS. 11 to 13 are sectional views of the primary parts of oil seal devices according to other embodiments of the present invention.
Figure 12:
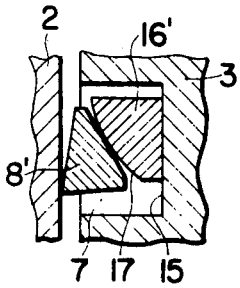
Figure 13:
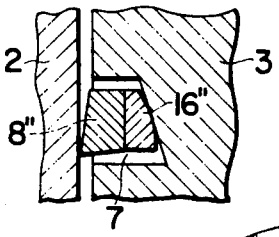

Referring to FIGS. 11 to 13, there are shown modified forms of an oil seal device according to the present invention. In the embodiment of FIG. 11, the bottom face 15 of the annular recess 7 is formed parallel to the thrust face of the rotor 3 and an annular elastic ring 16 is inserted into said recess so as to contact with the bottom face 15. The face of the elastic ring 16 which faces away from the bottom face 15 and is opposed to the side housing 2 forms a slant 17 which spreads outwardly in the radial direction, i.e., the depth of the ring 16 increases radially outwardly. Said annular elastic ring 16 has the cut ends like said seal ring 8, and such ends are joined through the medium of an elastic material such as plastic as in the preceding embodiment. Interposed between said elastic ring 16 and side housing 2 is a seal ring 8' which has a slant on its side opposed to the side housing 2 so that the inner peripheral edge in its radial direction along is contacted with the side housing 2. The face of the seal ring 8' contacted with the elastic ring 16 is arc-shaped in section and also tapered generally corresponding to the slant 17 of the elastic ring 16. Pressed contact between the seal ring 8' and the side housing 2 may be obtained by forming an arcuate-sectioned taper face on the elastic ring 16' while forming a planar slant on the corresponding side of the seal ring 8' so that said seal ring 8' and said elastic ring 16' will make linear contact as shown in FIG. 12. Also, the direction of inclination of said elastic ring 16' and seal ring 8' may be contrary to the radial direction of the rotor 3, i.e., the depth of the ring 16' may decrease radially outwardly. In these embodiments, a desired component force in the axial direction of the rotor 3 is produced as the elastic ring 16 (16') is fitted into the recess 7 in a contracted or expanded form so that its restorative force will work against the slant 17.

In the thus constructed oil seal device, the elastic ring 16 (16'), although having a restorative force, is held against either radial or axial movement by the bottom face of the sealing recess 7 and the seal ring 8' contacted with the side housing 2. In this case, since the elastic ring 16 (16') has a slant 17, the seal ring 8' develops an axial component force by the dint of the restorative force of said elastic ring so that said seal ring 8' and elastic ring 16 (16') are pressedly contacted with the side housing 2 and the slant 17 of the elastic ring 16 (16'), respectively, thus maintaining the excellent sealing performance.

In the embodiment shown in FIG. 13, the joined plane of the seal ring 8'' and elastic ring 16'' is parallel to the thrust face of the rotor 3 and the bottom face of the recess 7 is slanted, with the face of the elastic ring 16'' opposed to the slant bottom face being arc-shaped in section.

Figure 14:
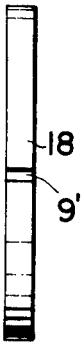
FIGS. 14 and 16 are side views of different forms of seal ring.
Figure 15:
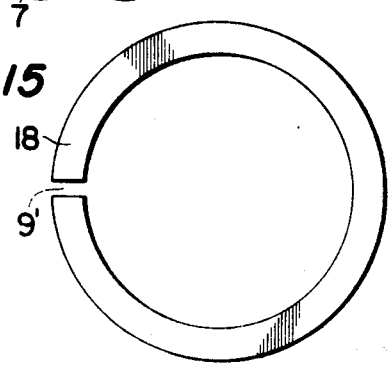
FIGS. 15 and 17 are plan views of FIGS. 14 and 16, respectively.
Figure 16:
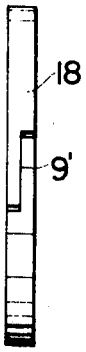
Figure 17:
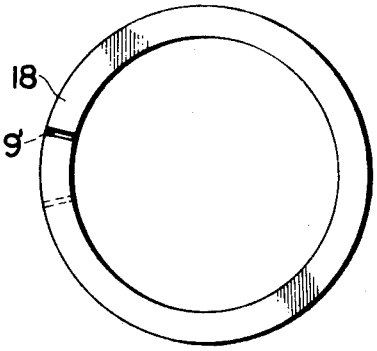

In FIGS. 14 to 17 are shown still other embodiments of the seal ring according to the present invention. In these embodiments, the C-shaped seal ring 18 is made of alloyed cast iron of the type used for a piston ring and is formed with a cut 9' at a location to provide a circumferential space in the ring. When fitting this ring 18 into the recess 7, the former is forced into the latter by either diminishing or expanding said space so that, when fitted in position, said seal ring 18 will have an expansive or contractive elastic force of the radial direction tending to restore it to the normal state. The cut 9' in the seal ring 18 may be of a type such as shown in FIGS. 14 and 15 or of a stepped type as shown in FIGS. 16 and 17. Fitting of the seal ring 18 into the recess 7 may be accomplished after the fashion of FIG. 3 or of FIG. 10. In the case of FIG. 3, the seal ring 18 is inserted by contracting it in the radial direction, and in the case of FIG. 10 it is inserted in a radially expanded form. In some cases, plastic 14 may not be provided on the slant 13 at the bottom of the recess 7.

In the thus arranged oil seal device, when a contractive or expansive force in the radial direction of the seal ring 18 works against the slant 13 of the recess 7, an axial component force is produced to strongly press the seal ring 18 against both side housing 2 and slant 13.

In case the seal ring 8' is formed like an endless loop and an elastic ring is disposed between said seal ring 8' and the bottom face 15 of the recess 7 as in the embodiments shown in FIGS. 11, 12 and 13, the elastic ring is provided with a cutout like said seal ring 18 and formed from alloyed cast iron of the type used for a piston ring.

The face of said elastic ring contacted with the seal ring 8′ is slanted like the slant 17 of said elastic ring 16. The direction of the slant may be contrariwise in the radial direction of the elastic ring, i.e., the depth of the ring decreases radially outwardly.

In the thus constructed oil seal device, the elastic ring is fitted radially in an either contracted or expanded state and the restitutive force of the thus fitted ring works to the seal ring 8′ through the slant of the elastic ring, so that there is consequently produced an axial force and thereby the seal ring 8 is pressedly attached against the side housing 2 and the slant of the elastic ring.

As described above, in the oil seal device according to the present invention, there is required no undulate spring for pressing the seal ring and hence there is no need of providing an O-ring for preventing leakage of lubricating oil in such section, thus allowing simplification of the seal mechanism. Also, the force with which the seal ring is pressed by the side housing acts uniformly to any part of the seal ring owing to the elasticity of said seal ring or elastic force of the elastic ring, so that stabilized sealing performance is obtained. Further, radial movement of the seal ring in the sealing recess quickly follows any deflection that would take place during eccentric rotation of the rotor to further ensure stable sealing practice.

I claim:

1. An oil seal device for a rotary engine characterized in that a rotor is provided capable of making eccentric rotation about an eccentric shaft within a rotor housing and side housing disposed covering both sides of said rotor housing, and annular recesses are provided in both side faces of said rotor so as to surround a hole through which the eccentric shaft extends, each of said recesses having a slant or bevel at its innermost end, and a radially elastic, annular seal ring supported by and having a surface in direct contact with each said slant or bevel for securing sealing between the respective sides of said rotor and the opposed faces of said side housing, at least one of said surface and said slant or bevel being arcuate, whereby after initial radial contraction or expansion each said seal ring is pressed axially against said side housing by radial movement of each said seal ring relative to its respective said slant or bevel caused by a restorative force from the initial contraction or expansion acting against the slant or bevel.

2. The oil seal device for a rotary engine as set forth in claim 1, wherein each said seal ring is C-shaped and the cutout ends of each C-shaped seal ring are joined through the medium of an elastic material so that each said ring can be contracted or expanded radially, whereby each said seal ring is pressed against the side housing as the contractive or expansive force of each said ring acts on said slant in each respective said annular recess.

3. The oil seal device for a rotary engine as set forth in claim 1, wherein said seal ring is a C-shaped elastic ring having a slant formed therein, and the cutout ends of said elastic ring are joined through the medium of an elastic material.

4. The oil seal device for a rotary engine as set forth in claim 1, wherein each seal ring has cutout ends and is inserted into each respective said annular recess with initial stress so that each said ring can be contracted or expanded radially, whereby each said seal ring is pressed against the side housing as the contractive or expansive force of each said ring acts on the slant in each respective said annular recess.

5. An oil seal device for a rotary engine characterized in that a rotor is provided capable of making eccentric rotation about an eccentric shaft within a rotor housing and side housing disposed covering both sides of said rotor housing, and annular recesses provided in both side faces of said rotor so as to surround a hole through which the eccentric shaft extends, each of said recesses having an elastic ring positioned on its innermost end, each elastic ring having a first slant or bevel portion, a radially elastic, annular seal ring positioned on each elastic ring for securing sealing between the respective sides of said rotor and the opposed faces of said side housing, one of each of said seal rings and the innermost ends of the corresponding recesses having a second slant or bevel portion substantially conforming, to and in direct contact with said first slant or bevel portion, at least one of said first and second slant or bevel portions being arcuate, whereby after initial radial contraction or expansion each said seal ring is pressed axially against said side housing by radial movement of each of said seal ring to one of its corresponding first and second slant or bevel portions caused by a restorative force from the initial contraction or expansion acting against one of its corresponding first and second slant or bevel portions.

6. The oil seal device for a rotary engine as set forth in claim 5, wherein the slant or bevel portion of each of said elastic rings is positioned on and generally conforms to a slant or bevel at the innermost end of each of the respective recesses.

7. The oil seal device for a rotary engine as set forth in claim 5, wherein the innermost end of each recess is generally parallel to its respective side face of the rotor, and the slant or bevel portion of each of said elastic rings faces away from the innermost end of its respective recess.

8. A rotary engine comprising:

a rotor housing, side housing for covering at least one side of said rotor housing, a rotor in said rotor housing for making eccentric rotation therein about an eccentric shaft, said rotor having at least one side face, an annular recess in said at least one side face of said rotor, said recess having therein a means defining a slanted surface, and a radially elastic, annular seal ring supported by and having a first surface in direct contact with the means defining a slanted surface in said recess for securing sealing between the side face of the rotor and the side housing, at least one of said first surface and said slanted surface being arcuate, whereby after initial radial contraction or expansion the radially elastic seal ring is pressed axially against said side housing by radial movement of said seal ring relative to the slanted surface caused by a restorative force from the initial contraction or expansion acting against the slanted surface.

9. The rotary engine of claim 8 wherein said means defining a slanted surface comprises the innermost end of the recess.

10. The rotary engine of claim 8 wherein said means defining a slanted surface comprises an elastic ring positioned in said recess between the innermost end thereof and said seal ring.

11. The oil seal device for a rotary engine as set forth in claim 8, wherein said means defining a slanted surface is an elastic ring having cutout ends and inserted into said annular recess, and said elastic ring is inserted into said annular recess with initial stress so that it can be contracted or expanded radially, whereby the seal ring is pressed against the side housing as the contractive or expansive force of said elastic ring acts on said seal ring through the slant on said elastic ring.

* * * * *